US006274799B1

(12) United States Patent
Shimizu

(10) Patent No.: US 6,274,799 B1
(45) Date of Patent: Aug. 14, 2001

(54) METHOD OF MAPPING WAVEFORMS TO TIMBRES IN GENERATION OF MUSICAL FORMS

(75) Inventor: Masahiro Shimizu, Hamamatsu (JP)

(73) Assignee: Yamaha Corporation

( * ) Notice: Subject to any disclaimer, the term of this patent is extended or adjusted under 35 U.S.C. 154(b) by 0 days.

(21) Appl. No.: 09/665,507

(22) Filed: Sep. 19, 2000

(30) Foreign Application Priority Data

Sep. 27, 1999 (JP) ..... 11-273155

(51) Int. Cl.[7] ..... G10H 1/06; G10H 7/00
(52) U.S. Cl. ..... 84/622
(58) Field of Search ..... 84/622–625

(56) References Cited

U.S. PATENT DOCUMENTS 5,412,154 5/1995 Takeda et al. .
5,763,800 6/1998 Rossum et al. .

OTHER PUBLICATIONS

"Sound Font® Technical Specification" Version 2.00a, dated Oct. 18, 1995.

"Downloadable Sounds Level 2" Version 0.8a Revised Jul. 24, 1998 Published By The MIDI Manufacturers Association Los Angeles, CA.

*Primary Examiner*—Stanley J. Witkowski
(74) *Attorney, Agent, or Firm*—Morrison & Foerster

(57) ABSTRACT

A storage medium stores a mapping file defining a set of timbres and mapping a plurality of waveforms to the set of timbres according to performance information. The mapping file is composed of a set of information blocks corresponding to the set of the timbres. The information block contains specification information for specifying waveforms associated to the corresponding timbre, and selection information for selecting one or more of the specified waveforms according to the performance information to thereby map the selected waveform to the timbre. The storage medium stores a first mapping file defining a first set of timbres and containing a plurality of waveforms originally mapped to the first set of timbres, and a second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file.

14 Claims, 10 Drawing Sheets

METHOD OF MAPPING WAVEFORMS TO TIMBRES IN GENERATION OF MUSICAL FORMS

BACKGROUND OF THE INVENTION

1. Field of the Invention

The present invention relates generally to a recording medium that is suitable for use in recording waveform data for electronic musical instruments or computer music, and a tone signal generating method that utilizes the recording medium of the waveforms.

2. Description of Related Art

Today, various types of waveform data are provided for use in electronic musical instruments or computer music. Standard formats such as DLS (Downloadable Sound) (Trademark) and Sound Font (Trademark) are proposed for transferring a set of timbre data through networks or recording media.

The data structure of a timbre set file in DLS is shown in FIG. 2(*a*). As shown, reference numeral 100 denotes a timbre set file composed of an INFO chunk 101, a WAVE DATA chunk 102, and a PRESET DATA chunk 103. The INFO chunk 101 contains various pieces of information about the timbre set file such as a timbre set name, a label of a creator, and the date of creation.

The WAVE DATA chunk 102 contains sampling values of various types of waveform data. The PRESET DATA chunk 103 contains specific information about timbres. The timbre set file 100 generally stores plural pieces of timbre data, each being associated to a program change event and a bank select event of the GM (General MIDI) standard.

FIG. 2(*b*) shows an exemplary mapping of the timbre set file 100. In the figure, the horizontal axis represents a program change event and the vertical axis represents a bank select event. The timbre data are stored in a hatched area 105. In the above-mentioned PRESET DATA chunk 103, data blocks called INST blocks are arranged in correspondence to the timbres.

FIG. 3 shows an INST block corresponding to a certain timbre. As shown, the INST block 110 is made up of a number section 111, a parameter section 112, and a pointer section 113. The number section 111 stores the above-mentioned program change and bank select events. The parameter section 112 stores parameters such as envelope waveform, filtering characteristic, and LFO.

The pointer section 113 stores plural pointers for pointing plural region blocks 120, 130, . . . , 190. These region blocks are provided in correspondence to key regions (or pitch regions) and velocity regions of a key touch to generate different waveforms in correspondence to these key regions and velocity regions.

The region block 120 is made up of a region section 121 for storing the region information indicative of the above-mentioned key region and velocity region, a parameter section 122 for storing parameters such as envelope waveform, filtering characteristic, and LFO, and a pointer section 123 for storing pointers designating the waveform data corresponding to that region. It should be noted that the waveform data pointed by the pointer section 123 are stored in the above-mentioned WAVE DATA chunk 102.

The remaining region blocks 130 through 190 are configured generally in the same manner as the above-mentioned region block 120. As described above, in the parameter section 112 of the INST block 110 and in the parameter sections 122, 132, . . . , 192 of the region blocks

120, 130, . . . , 190, parameters of the same types may be defined. If the parameters of different values are specified at plural locations for the same waveform data, high-order parameters as viewed from the INST block 110 are preferred. For example, if envelope waveforms are defined in the parameter section 122 and the parameter section 112, the definition of the parameter section 112 precedes to the definition of the parameter section 122.

This preference is given to secure the sense of integrity in the parameter section 112 when diverting a region block and waveform data originally created for one timbre to another timbre. Therefore, generally, the parameter section of the region block defines all parameters and the parameter section 112 of the INST block 110 defines only necessary parameters.

The following briefly describes an operation for generating a music tone signal in a tone generator (this may be a dedicated tone generator or a personal computer) by use of the above-mentioned timbre set file 100. First, when a program change event or a bank select event of MIDI is supplied to the tone generator, its contents are stored in the tone generator, thereby identifying an INST block 110 to be accessed.

Next, when a note-on event (accompanied by a key code and a key velocity) is supplied to the tone generator, a corresponding region block is identified, thereby the pointer section thereof identifying the waveform data to be read out. These waveform data are read out at an amplitude corresponding to the key velocity and at a pitch corresponding to the key code, thereby imparting the pitch to the music tone.

The parameter section of the corresponding region block and the parameter section 112 of the INST block 110 are read, and parameter values to be applied to the waveform data are determined while the latter precedes to the former. When the determined parameter is applied to the waveform data, the music tone signal is synthesized.

However, in the above-mentioned technology, a variation of the timbres applied to the tone signals is limited and concluded in one timbre set file. Namely, even if the user obtains a plurality of timbre set files, the user can use only the parameters and waveform data that exist in one file. Therefore, it is impossible in the related-art technology to constitute timbres based on the plural timbre set files.

SUMMARY OF THE INVENTION

It is therefore an object of the present invention to provide a recording medium and a tone signal generating method that can provide a variety of timbres.

In one aspect of the invention, a storage medium stores a mapping file defining a set of timbres and mapping a plurality of waveforms to the set of timbres according to performance information. The mapping file comprises a set of information blocks corresponding to the set of the timbres. The information block contains specification information for specifying waveforms associated to the corresponding timbre, and selection information for selecting one or more of the specified waveforms according to the performance information to thereby map the selected waveform to the timbre. The storage medium stores a first mapping file defining a first set of timbres and containing a plurality of waveforms originally mapped to the first set of timbres, and a second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file.

Preferably, the second mapping file contains the attribute information indicating that the second set of the timbres is added as a supplement to the first set of the timbres.

Preferably, the information block contains the selection information for selecting different waveforms according to either of a key code and a key velocity contained in the performance information such that the different waveforms are dynamically mapped to the same timbre in response to a change of the key code or the key velocity.

Preferably, the information block contains individual parameter information for individually characterizing each of the specified waveforms when mapping each of the specified waveforms to the timbre, and common parameter information for commonly characterizing all of the specified waveforms. In such a case, the common parameter information precedes to the individual parameter information when a conflict occurs therebetween.

In anther aspect of the invention, a storage medium stores a mapping file defining a set of timbres and mapping a plurality of waveforms to the set of timbres according to performance information. The mapping file comprises a set of information blocks corresponding to the set of the timbres. The information block contains specification information for specifying waveforms associated to the corresponding timbre, and selection information for selecting one or more of the specified waveforms according to the performance information to thereby map the selected waveform to the timbre. The storage medium stores a first mapping file defining a first set of timbres, a second mapping file defining a second set of timbres, and a third mapping file defining a third set of timbres and containing attribute information for linking the third mapping file to both of the first mapping file and the second mapping file, thereby combining the first set of timbres and the second set of timbres to synthesize the third set of timbres, such that the third mapping file involves an information block containing specification information for specifying information blocks contained in the first and second mapping files to indirectly specify waveforms.

Preferably, the third mapping file contains the attribute information indicating that the third set of the timbres is synthesized from the first set of the timbres and the second set of the timbres.

In a different aspect of the invention, a method of operating a tone generator is provided for generating a music tone in response to performance information by a desired timbre with using a mapping file defining a set of timbres and mapping a plurality of waveforms to the set of timbres. The mapping file is composed of a set of information blocks corresponding to the set of the timbres. The information block contains specification information for specifying waveforms associated to the corresponding timbre, and selection information for selecting one or more of the specified waveforms according to the performance information to map the selected waveform to the timbre. The inventive method comprises the steps of sequentially feeding the performance information to the tone generator, loading a first mapping file and a second mapping file to the tone generator, the first mapping file defining a first set of timbres and containing a plurality of waveforms originally mapped to the first set of timbres, the second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file, reading an information block of the second mapping file corresponding to the desired timbre and containing specification information for specifying waveforms contained in the first mapping file, selecting one or more of the specified waveforms according to the performance information to thereby map the selected waveform to the desired timbre, and processing the mapped waveform to generate a music tone having the desired timbre.

In a further aspect of the invention, a method of operating a tone generator is provided for generating a music tone in response to performance information by a desired timbre with using a mapping file defining a set of timbres and mapping a plurality of waveforms to the set of timbres. The mapping file is composed of a set of information blocks corresponding to the set of the timbres. The information block contains specification information for specifying waveforms associated to the corresponding timbre, and selection information for selecting one or more of the specified waveforms according to the performance information to map the selected waveform to the timbre. The inventive method comprises the steps of sequentially feeding the performance information to the tone generator, loading a first mapping file, a second mapping file, and a third mapping file to the tone generator, the first mapping file defining a first set of timbres, the second mapping file defining a second set of timbres, the third mapping file defining a third set of timbres and containing attribute information for linking the third mapping file to both of the first mapping file and the second mapping file, thereby combining the first set of timbres and the second set of timbres to synthesize the third set of timbres, such that the third mapping file involves an information block containing specification information for specifying information blocks contained in the first and second mapping files to indirectly specify waveforms, reading an information block of the third mapping file corresponding to the desired timbre and containing specification information for specifying information blocks contained in the first and second mapping files to indirectly specify waveforms, selecting one or more of the specified waveforms according to the performance information to thereby map the selected waveform to the desired timbre, and processing the mapped waveform to generate a music tone having the desired timbre.

BRIEF DESCRIPTION OF THE DRAWINGS

These and other objects of the invention will be seen by reference to the description, taken in connection with the accompanying drawings, in which:

FIG. 2(*b*) illustrates an exemplary mapping of a normal timbre set file;

FIG. 4(*b*) illustrates a result of mapping using a pair of timbre set files;

FIG. 6(*b*) illustrates a timbre map of the combined timbre set file of the above-mentioned embodiment;

FIG. 8(*b*) illustrates a timbre map of the waveform combined timbre set file of the above-mentioned embodiment;

DETAILED DESCRIPTION OF PREFERRED EMBODIMENTS

1. Configuration of Embodiments

Figure 1:
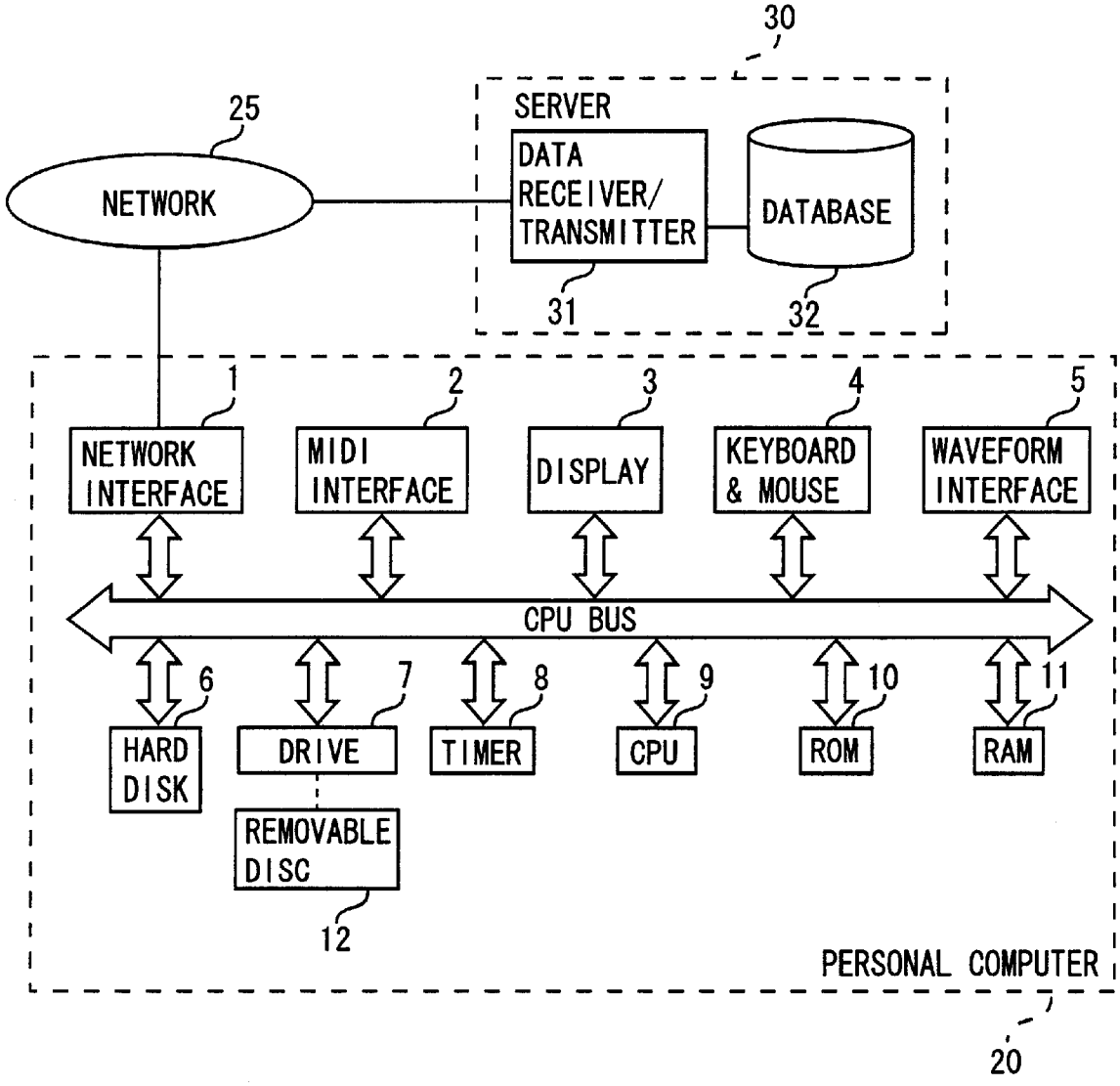
FIG. 1 is a block diagram illustrating a tone signal generating apparatus practiced as one preferred embodiment of the invention.

This invention will be described in further detail by way of example with reference to the accompanying drawings. Now, with reference to FIG. 1, a configuration of one embodiment of the invention will be described. It should be noted that the present embodiment is a music apparatus or music tone generating apparatus based on a general-purpose personal computer 20.

Reference numeral 1 denotes a network interface, which interfaces the personal computer 20 with a network 25. Reference numeral 2 denotes a MIDI interface connected to MIDI equipment such as a keyboard and a tone generator to transfer MIDI data with the MIDI equipment. Reference numeral 3 denotes a display for indicating various types of information to the user. Reference numeral 4 denotes an input device composed of a keyboard and a mouse for example to supply various types of operation information to a CPU 9 according to operations done by the user.

Reference numeral 10 denotes a ROM, which stores an initial program loader for boosting the personal computer 20. Reference numeral 11 denotes a RAM to which the CPU 9 writes data and from which the CPU 9 reads data. Reference numeral 5 denotes a waveform interface, which collects analog tone signals through a microphone for example, converts the collected analog tone signals into PCM data, and stores the PCM data in the RAM 11. At the same time, the waveform interface 5 converts the PCM data stored in the RAM 11 into an analog signal which is sounded by a sound system, not shown.

Reference numeral 6 denotes a hard disk for storing an operating system, drivers, application programs, and timbre set files, which are loaded into the RAM 11. Reference numeral 7 denotes a disk drive for writing data to and for reading data from a storage medium in the form of a removable disk such as a CD-ROM or a floppy disc. Reference numeral 8 denotes a timer, which generates a timer interrupt for the CPU 9 at a predetermined time interval. Reference numeral 30 denotes a remote server composed of a data transmitter/receiver 31 for transmitting and receiving various types of data with the network 25 and a data storage device 32 for storing software provided for the user.

2. Data Configuration Adopted by the Embodiment

In the present embodiment, various timbre set files are stored in the hard disk 6. The types of these timbre set files are as follows.

2.1 Normal Timbre Set File

Figure 2A:
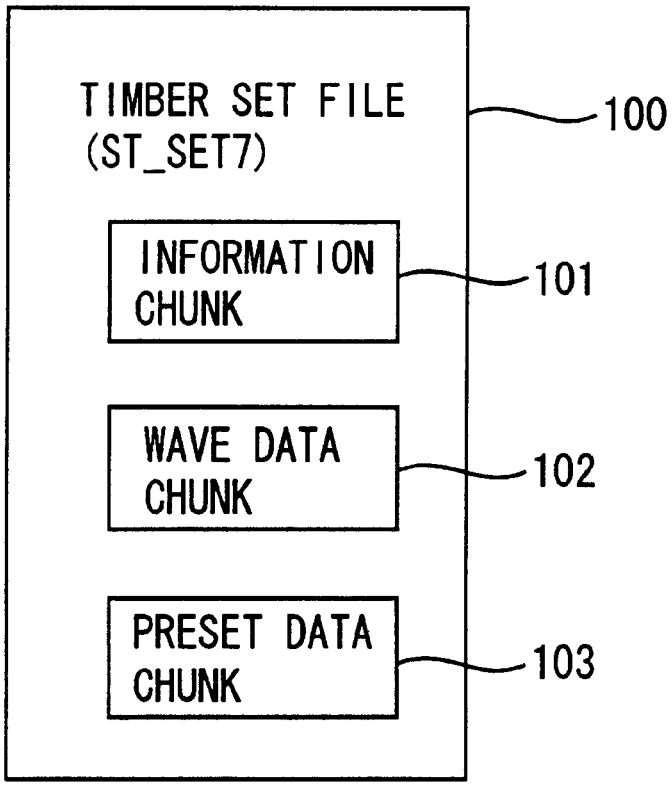
FIG. 2(*a*) illustrates a data structure of a timbre set file in DLS.
Figure 2B:
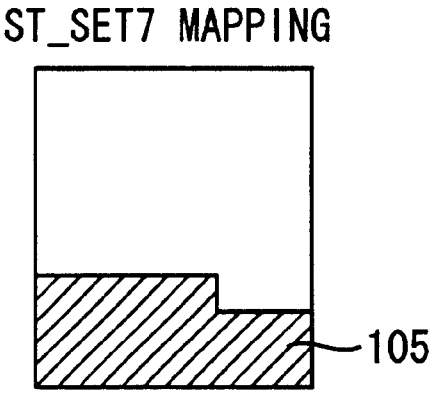

A normal timbre set file has the configuration used by the related-art technology described with reference to FIGS. 2 and 3.

2.2 Additional Timbre Set File

Figure 4A:
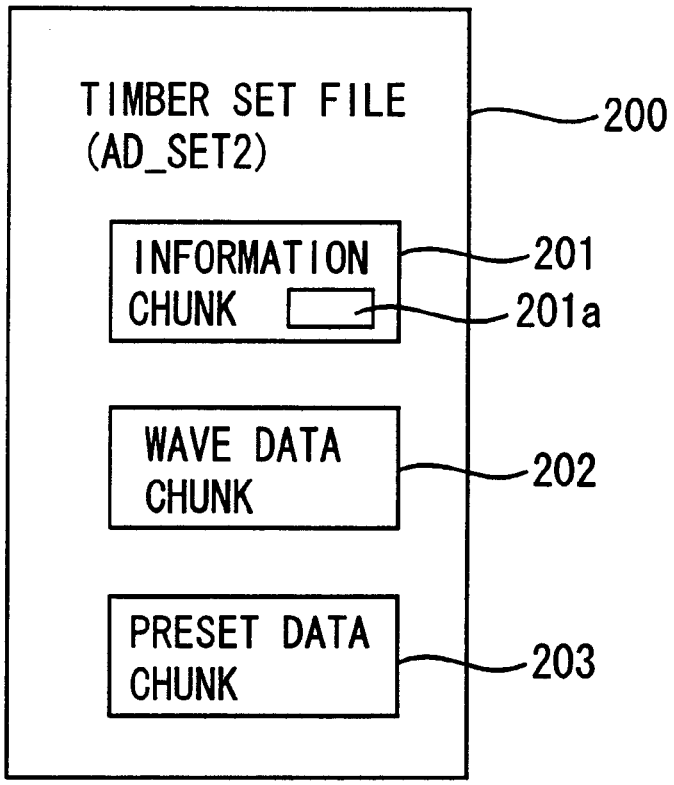
FIG. 4(*a*) illustrates a data structure of an additional timbre set file.
Figure 4B:
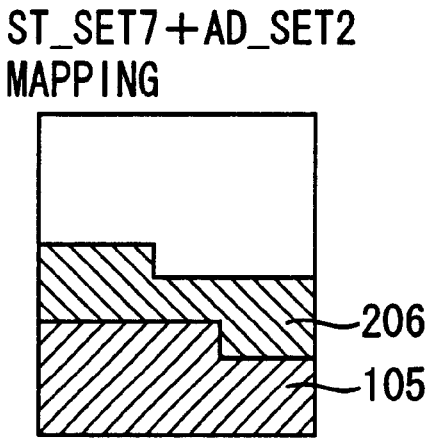

An additional timbre set file can be provided as an upgrade version or an option for the normal timbre set file. The data configuration of an additional timbre set file 200 is shown in FIG. 4(*a*). As shown, like the normal timbre set file 100, the additional timbre set file 200 is made up of an INFO chunk 201, a WAVE DATA chunk 202, and a PRESET DATA chunk 203.

Like the INFO chunk 101, the INFO chunk 201 stores a timbre set name (AD_SET2 in this example), a label of a creator, the date of creation, and other various information about the additional timbre set file 200. In addition, the INFO chunk 201 includes attribute information 201*a* of the timbre set file 200. The attribute information 201*a* identifies the type of the timbre set file 200, the name of the other timbre set file 100 to be referenced, and the relationship between the timbre set files 100 and 200.

If the additional timbre set file 200 stores timbres additional to the normal timbre set file 100 (ST_SET7), the contents of the attribute information 201*a* indicate that this timbre set is supplement to the timbre set ST_SET7. The WAVE DATA chunk 202 stores the sample values of various types of waveform data as with the WAVE DATA chunk 102.

The PRESET DATA chunk 203 contains specific information about timbres as with the PRESET DATA chunk 103. However, in the PRESET DATA chunk 203, the information in the timbre set file 100 is referenced as required (details being described later). Each piece of timbre data in the additional timbre set file 200 is associated to to the program change and bank select events of the GM (General MIDI) standard so as not to overlap the timbre data stored in the timbre set file 100.

FIG. 4(*b*) shows a result of the mapping by the pair of the timbre set files 100 and 200. In the figure, an area 105 is the same as that shown in FIG. 2(*b*). To the area 105, an area 206 is added to form the area for the additional timbre set file 200. In the PRESET DATA chunk 203 of the additional timbre set file 200, each INST block is arranged for each timbre in the area 206.

Figure 5:
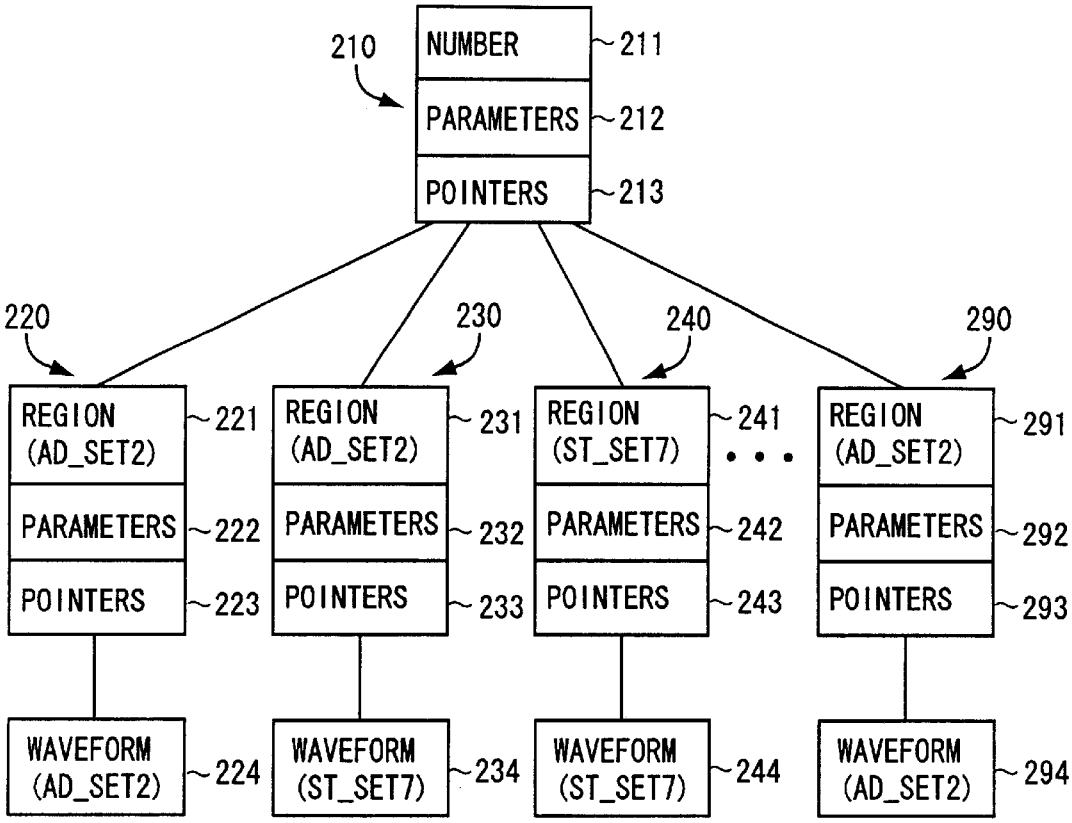
FIG. 5 illustrates a data structure of an additional timbre set file of the above-mentioned embodiment.

An example of the INST block in the PRESET DATA chunk 203 is shown in FIG. 5. In the figure, like the INST block 110 of the normal timbre set file 100, an INST block 210 is made up of a number section 211, a parameter section 212, and a pointer section 213. The pointer section 213 stores plural pointers for pointing plural region blocks 220, 230, . . . , 290.

Like the region blocks 120 and so on described with reference to FIG. 3, the region blocks 220, 230, . . . , 290 are each made up of a region section for storing region information about key range and velocity range, a parameter section for storing parameters such as envelope waveform, filtering characteristic, and LFO, and a pointer section for storing pointers specifying the waveform data corresponding to the region.

However, the region blocks 220, 230, . . . , 290 are not always stored in the PRESET DATA chunk 203. They may be found in another timbre set file to which the file 200 is added. The other timbre set file to which the present file is added is referred to as a parent timbre set file. In the above-mentioned embodiment, the parent timbre set file is the normal timbre set file 100, and the region block 240 pointed by the INST block 210 is found in this normal timbre set file 100. It should be noted that the parent timbre set file is not limited to the normal timbre set file.

Thus, when the pointing to the region blocks of the parent timbre set file is made, if a certain velocity range and a key range assigned to an additional timbre is the same as that in the parent timbre set, an existing region block may be pointed for that velocity range and the key range. This eliminates the necessity for duplicate storing of any region block and waveform data having the contents common to the timbre set files 100 and 200.

In the region block with an entity stored in the PRESET DATA chunk 203, the waveform data to be pointed by the pointer section are not always stored in the WAVE DATA chunk 202; rather, the waveform data may be stored in the parent timbre set file. For example, as shown in FIG. 5, the entity of the region block 230 itself is stored in the PRESET DATA chunk 203; however, waveform data 234 pointed by the pointer section 233 of the region block 230 are stored in the WAVE DATA chunk 102 of the normal timbre set file 100.

According to the above-mentioned data configuration, the waveform data of the parent timbre set file may be diverted to provide timbres having different parameters and region information into the additional timbre set file 200. Further, the above-mentioned data configuration makes it unnecessary for the same waveform data to be stored in both the timbre set files 100 and 200.

Namely, the storage medium 12 may be provided for storing a mapping file defining a set of timbres and mapping a plurality of waveforms to the set of timbres according to performance information. For example, the mapping file 100 comprises a set of information blocks corresponding to the set of the timbres. For example, one information block composed of one INST block 110 and plural region blocks 120–190 contains specification information (pointers) for specifying waveforms associated to the corresponding timbre, and selection information (regions) for selecting one or more of the specified waveforms according to the performance information to thereby map the selected waveform to the timbre. Specifically, the storage medium 12 stores a first mapping file (parent file) 100 defining a first set of timbres and containing a plurality of waveforms originally mapped to the first set of timbres, and a second mapping file (child file) 200 defining a second set of timbres and containing attribute information 201*a* for linking the second mapping file 200 to the first mapping file 100 to enable mapping of the waveforms contained in the first mapping file 100 to the second set of the timbres, such that the second mapping file 200 may involve an information block, as shown in FIG. 5, containing specification information 233 and 243 for specifying waveforms 234 and 244 contained in the first mapping file 100.

Particularly, the second mapping file 200 contains the attribute information 201*a* indicating that the second set of the timbres is added as a supplement to the first set of the timbres. As shown in FIG. 5, the information block contains the selection information 221–291 for selecting different waveforms 224–294 according to either of a key code and a key velocity contained in the performance information such that the different waveforms 224–294 are dynamically mapped to the same timbre in response to a change of the key code or the key velocity. As shown in FIG. 5, the information block contains individual parameter information 222–292 for individually characterizing each of the specified waveforms 224–294 when mapping each of the specified waveforms 224–294 to the timbre, and common parameter information 212 for commonly characterizing all of the specified waveforms 224–294. In such a case, the common parameter information 212 precedes to the individual parameter information 222–292 when a conflict occurs therebetween.

2.3 Combined Timbre Set File

Figure 6A:
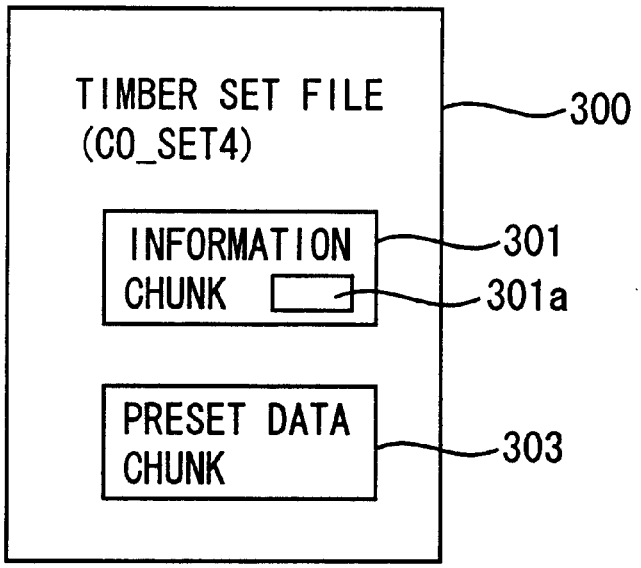
FIG. 6(*a*) illustrates a memory map of a combined timbre set file of the above-mentioned embodiment.
Figure 6B:
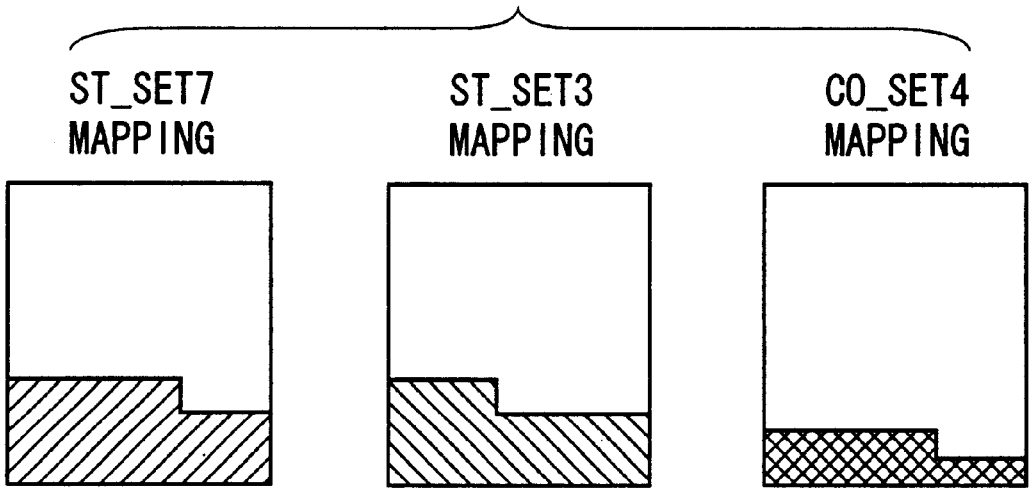

A combined timbre set file denotes a timbre set file for use in an ensemble performance for example with timbres in one or more timbre set files. The data configuration of a combined timbre set file 300 is shown in FIG. 6(*a*). Like the normal timbre set file 100, the combined timbre set file 300 has an INFO chunk 301 and a PRESET DATA chunk 303 but this file has no WAVE DATA chunk.

Like the INFO chunk 101, the INFO chunk 301 stores a file set name (CO_SET4 in this example), a label of a creator, the date of creation, and other various information about the combined timbre set file 300. Further, like the INFO chunk 201, the INFO chunk 301 includes attribute information 301*a* of the timbre set file 300.

When the combined timbre set file 300 is formed by combining one timbre set file 100 (ST_SET7) and another timbre set file (ST_SET3), the attribute information 301*a* provides information indicating that this timbre set provides ensemble information to be used by combining the timbre set ST_SET7 and the timbre set ST_SET3. Although not especially shown, the timbre set file corresponding to the timber set ST_SET3 has the same configuration as that of the timbre set ST_SET7.

A result of the mapping of the timbre sets ST_SET3, ST_SET7, and CO_SET4 is shown in FIG. 6(*b*). As shown, the program change and bank select of each timbre in the timbre set CO_SET4 are provided independently of those in the timbre sets ST_SET3 and ST_SET7.

Figure 7:
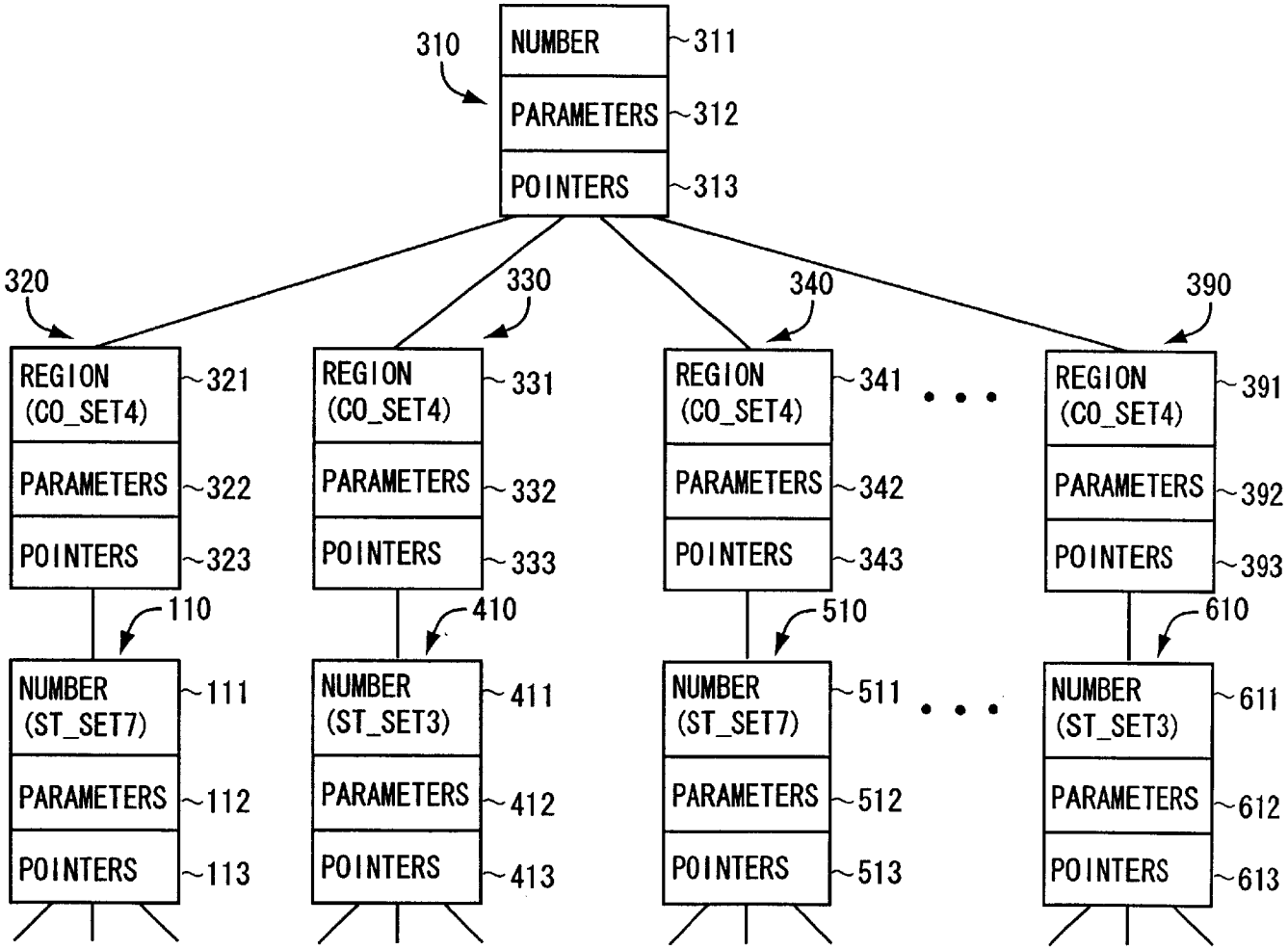
FIG. 7 illustrates a data structure of the combined timbre set file of the above-mentioned embodiment.

Referring to FIG. 7, there is shown an example of an INST block arranged in correspondence to one timbre of the timbre set CO_SET4 in the PRESET DATA chunk 303. In the figure, an INST block 310 is made up of a number section 311, a parameter section 312, and a pointer section 313 as with the INST block 110 of the normal timbre set file 100. The pointer section 313 stores plural pointers for pointing plural region blocks 320, 330, . . . , 390.

Like the region blocks 120 and so on described with reference to FIG. 3, the region blocks 320, 330, . . . , 390 are each made up of a region section for storing region information, a parameter section for storing parameters such as envelope waveform, filtering characteristic, and LFO, and a pointer section.

However, pointer sections 323, 333, . . . , 393 of the region blocks 320, 330, . . . , 390 provide pointers not designating waveform data but designating INST blocks of the combined timbre set files. In the above-mentioned example, the timbre set CO_SET4 is a combination of the timbre sets ST_SET3 and ST_SET7, so that the pointer sections 323, 333, . . . , 393 point the INST blocks involved in the timbre set ST_SET7 or the INST blocks involved in the timbre set ST_SET3.

In the shown example, INST blocks 110, 410, 510, 610 are pointed by the pointer sections 323, 333, . . . , 393, respectively. These INST blocks all belong to the timbre set ST_SET3 or ST_SET7. It should be noted that the plural pointers 323, 333, . . . , 393 may point one INST block.

Like the region section 121 of the normal timbre set file 100, the region sections 321, 331, . . . , 391 of the above-mentioned region blocks 320, 330, . . . , 390 each store the region information corresponding to each region block. In order to play in concert with the timbre sets ST_SET3 and ST_SET7 in a desired region, the same region information is stored in the region sections of the two region blocks.

For example, when the same region information is stored in the region sections 321 and 331, their pointer sections 323 and 333 link the INST blocks 110 and 410, so that music tone signals for the INST blocks 110 and 410 are reproduced for ensemble in sounding process of the music tones (of which details will be described later). It should be noted that, in other timbre set files than the combined timbre set file 300, the user can also instruct an ensemble by partially or totally overlapping the region information in plural region sections as described above.

Namely, the storage medium 12 stores a first mapping file 100 defining a first set of timbres, a second mapping file 200 defining a second set of timbres, and a third mapping file 300 defining a third set of timbres and containing attribute information 301*a* for linking the third mapping file 300 to both of the first mapping file 100 and the second mapping file 200, thereby combining the first set of timbres and the second set of timbres to synthesize the third set of timbres, such that the third mapping file 300 involves an information block, as shown in FIG. 7, containing specification information 313 for specifying information blocks 110, 410, 510 and 610 contained in the first and second mapping files 100 and 200 to indirectly specify waveforms. Specifically, the third mapping file 300 contains the attribute information 301*a* indicating that the third set of the timbres is synthesized from the first set of the timbres and the second set of timbres.

2.4 Waveform Combined Timbre Set File

Figure 8A:
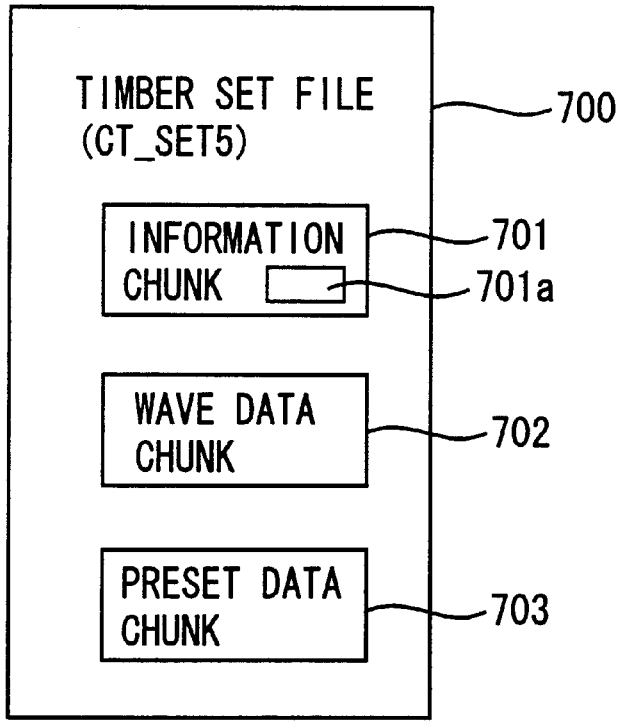
FIG. 8(*a*) illustrates a memory map of a waveform combined timbre set file of the above-mentioned embodiment.
Figure 8B:
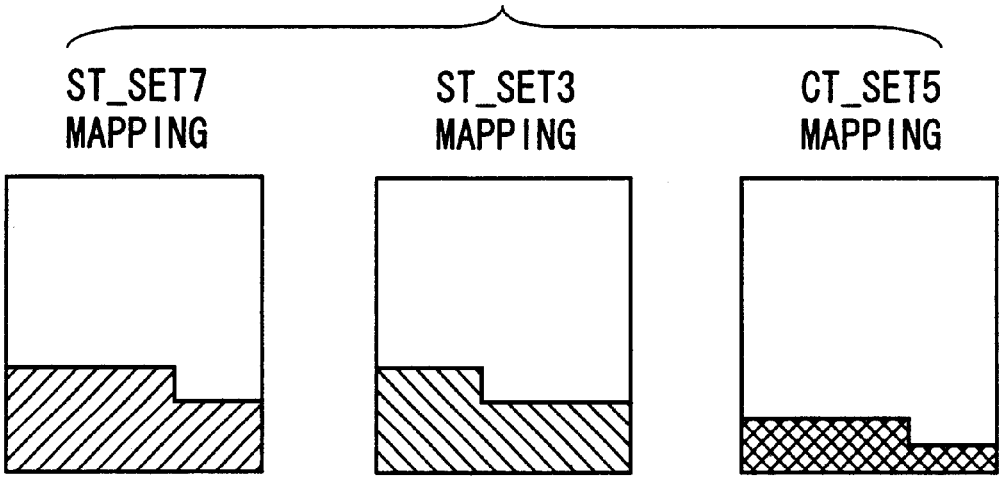

A waveform combined timbre set file denotes a timbre set file created by diverting the waveform data in one or more timbre set files and by using unique waveform data as required, thereby providing a new timbre. The data configuration of such a waveform combined timbre set file is shown in FIG. 8(*a*). Like the normal timbre set file 100, a waveform combined timbre set file 700 has an INFO chunk 701, a WAVE DATA chunk 702, and a PRESET DATA chunk 703.

Like the INFO chunk 101, the INFO chunk 701 stores a file set name (CT_SET5, in this example), a label of a creator, the date of creation, and other various information about the waveform combined timbre set file 700. Further, like the INFO chunk 201, the INFO chunk 701 includes attribute information 701*a* of the waveform combined timbre set file 700.

If the waveform combined timbre set file 700 adopts or utilizes the waveform data of one normal timbre set file 100 (ST_SET7) and another timbre set file (ST_SET3), the attribute information 701*a* provides information indicating that this timbre set file provides the information about usage of the waveform data of the timbre set ST_SET7 and timbre set ST_SET3.

A result of the mapping of the timbre sets ST_SET3, ST_SET7, and CT_SET5 is shown in FIG. 8(*b*). As shown, the program change and bank select of each timbre in the timbre set CT_SET5 are set independently from those of the timbre sets ST_SET3 and ST_SET7.

Figure 9:
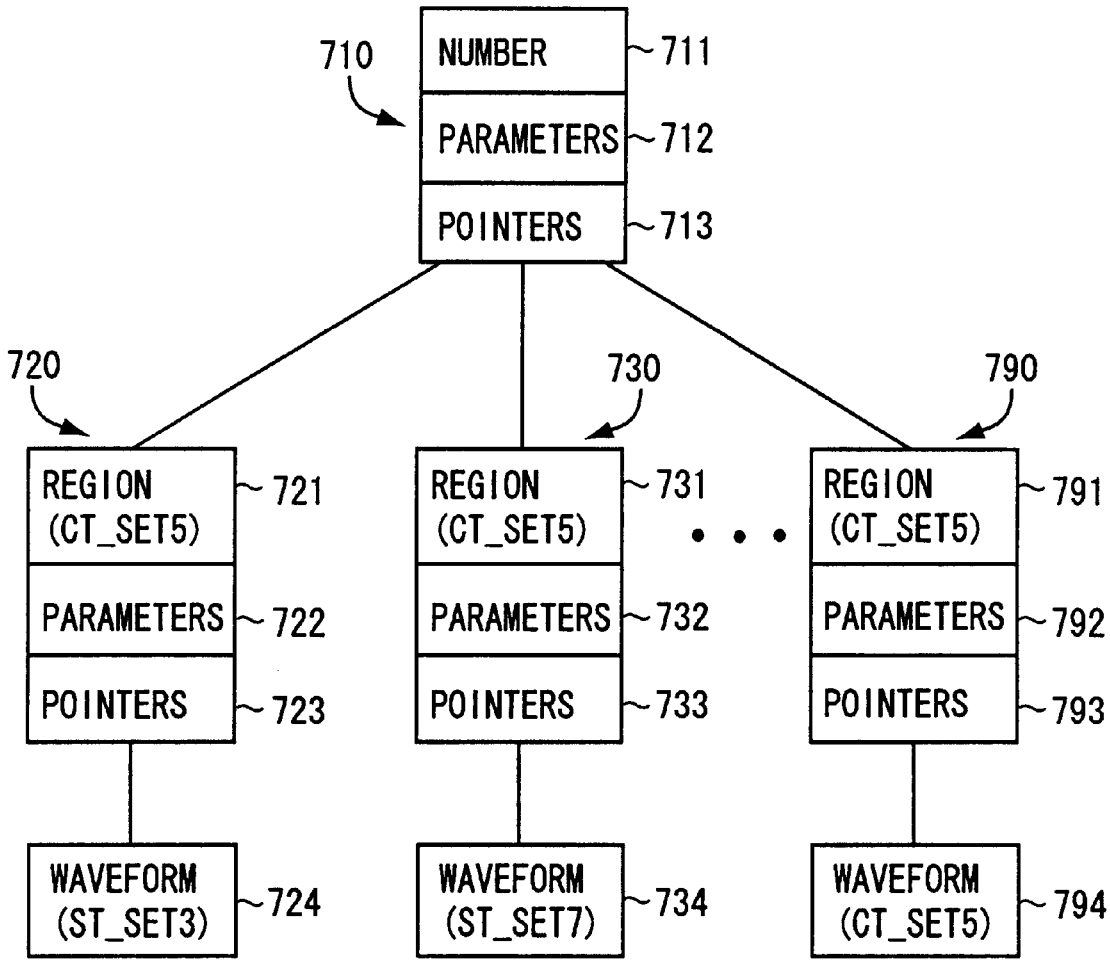
FIG. 9 is a data structure of the waveform combined timbre set file of the above-mentioned embodiment.

FIG. 9 shows an example of an INST block arranged for one timbre in the timbre set CT_SET5 in the PRESET_DATA chunk 703. In the figure, an INST block 710 is made up of a number section 711, a parameter section 712, and a pointer section 713 as with the INST block 110 of the normal timbre set file 100. The pointer section 713 stores plural pointers for pointing the plural region blocks 720, 730, . . . , 790.

Like the region block 120 and so on described with reference to FIG. 3, the region blocks 720, 730, . . ., 790 are each made up of a region section for storing region information, a parameter section for storing parameters such as envelope waveform, filtering characteristic, and LFO, and a pointer section.

However, the pointer sections 723, 733, . . . , 793 of the region blocks 720, 730, . . . , 790 point not only the waveform data in the timbre set CT_SET5 but also the waveform data in the timbre sets ST_SET3 and ST_SET7. In the example shown, the waveform data 724 placed in the timbre set ST_SET3 are pointed by the pointer section 723, and the waveform data 734 involved in the timbre set ST_SET7 are pointed by the pointer section 733. The waveform data 794 involved in the waveform combined timbre set file 700 are pointed by the pointer 793.

3. Operation of the Embodiments 3.1 Reception of Note-On Event

In the present embodiment, a software executed on the personal computer 20 is generally referred to as a tone generating module which simulates the operations of a hardware tone generator.

The tone generating module generates PCM data for a tone signal on the basis of the MIDI data generated by an application program such as electronic musical instrument software and game software or the MIDI data received through the MIDI interface 2, and loads and expands the generated PCM data into the RAM 11. The expanded waveform data are transferred to the waveform interface 5 by a bus driver of the waveform interface 5.

The tone generating module can generate tone signals for plural parts at the same time, a timbre designated by a program change and a bank select being allocated beforehand to each part. The following describes processing to be executed when a note-on event of the performance information is supplied to the tone generating module with reference to FIG. 10. It should be understood that this note-on event includes part PT, note number NN, and velocity VEL associated with this event.

Figure 10:
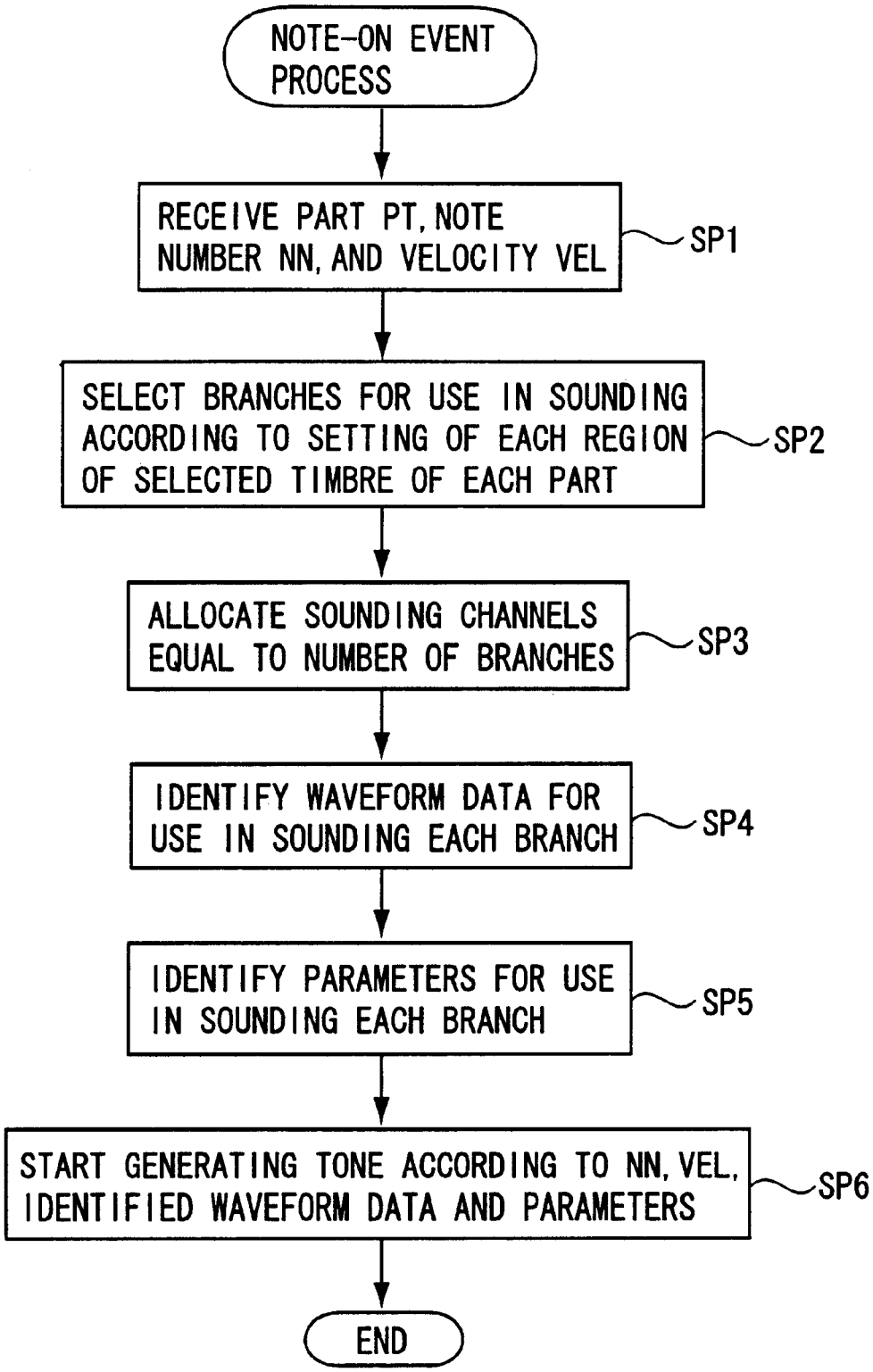
FIG. 10 is a flowchart of a control program of the above-mentioned embodiment.

When a note-on event is supplied to the tone generating module by an application program for example, a routine shown in FIG. 10 starts. In the figure, when the processing proceeds to step SP1, the part PT, the note number NN, and the velocity VEL are received from a calling program.

3.2 Establishing a Number of Branches

In step SP2, branches (channels) to be used for sounding and the number of these branches are selected on the basis of the settings of the regions of the timbres associated with the part PT. Details of this processing will be described below for each type of timbre set file.

(1) For the Normal Timbre Set File or the Waveform Combined Timbre Set File:

First, description is given to the processing executed when the normal timbre set file (refer to FIGS. 2 and 3) is used in the tone generating module. Because the part PT supplied from an application program is related beforehand to a program change and a bank select, the part PT identifies one INST block in the PRESET_DATA chunk 103.

Figure 3:
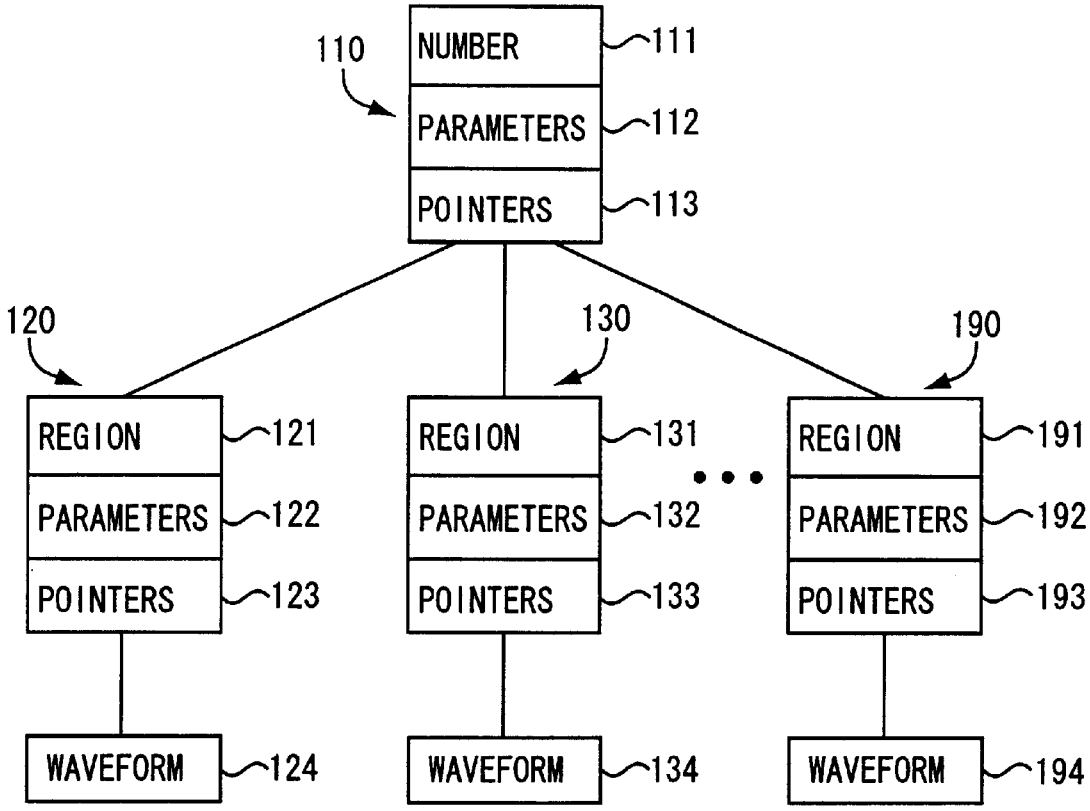
FIG. 3 illustrates a data structure of the normal timbre set file of the related-art technology and the above-mentioned embodiment.

The INST block identified here is the INST block 110 for example shown in FIG. 3. Next, the plural pointers in the pointer section 113 are sequentially referenced, thereby sequentially reading the contents of the region sections 121, 131, . . . , 191 in the region blocks 120, 130, . . . , 190 pointed by these pointers. Then, it is sequentially determined whether the note number NN and the velocity VEL supplied before belong to each of the regions specified by the key and velocity ranges).

When this processing has been executed on all the region blocks 120, 130, . . . , 190 pointed by the pointer section 113, the number of region blocks corresponding to the note-number NN and the velocity VEL is established. The established number of region blocks is equal to the number of branches.

If the waveform combined timbre set file (refer to FIGS. 8 and 9) is used in the tone generating module, the waveform data in other timbre set file are used. The processing up to the establishment of the number of regions or branches is the same as with the normal timbre set file.

(2) For the Additional Timbre Set File:

The following describes processing to be executed when the additional timbre set file (refer to FIGS. 4 and 5) is used in the tone generating module. In this case also, the part PT supplied from an application program for example is related beforehand to a timbre in terms of a program change and a bank select, so that the part PT identifies one INST block in the PRESET DATA chunk 203.

The INST block identified here is the INST block 210 for example shown in FIG. 5. Next, the plural pointers in the pointer section 213 are sequentially referenced, thereby sequentially reading the contents of the region sections 221, 231, 241, . . . , 291 of the region blocks 220, 230, . . . , 290 pointed by these pointers. Then, it is sequentially determined whether the note number NN and the velocity VEL supplied before belong to each of the regions.

Here, the region block 240 is a block involved in the timbre set file 100, which is the parent timbre set file. Because the message indicating that this timbre set provides additional information to the timbre set ST_SET7 is contained in the attribute information 201*a* in the INFO chunk 201, the region block in the timbre set ST_SET7 is also read.

When this processing has been executed on all the region blocks 220, 230, . . . , 290 pointed by the pointer section 213, the number of region blocks corresponding to the note-number NN and the velocity VEL is established. The established number of region blocks is equal to the number of branches.

(3) For the Combined Timbre Set File:

Next, the description is given to the process executed when the combined timbre set file (refer to FIGS. 6 and 7) is used in the tone generating module. In this case also, the part PT supplied from an application program for example is related beforehand to a program change and a bank select, so that the part PT identifies one INST block in the PRESET DATA chunk 303 in correspondence to a timbre specified by the program change and the bank select.

The INST block identified here is the INST block 310 for example shown in FIG. 7. Next, the plural pointers in the pointer section 313 are sequentially referenced, thereby sequentially reading the contents of the region sections 321, 331, 341, . . . , 391 of the region blocks 320, 330, . . . , 390 pointed by these pointers. Then, it is sequentially determined whether the note number NN and the velocity VEL supplied before belong to each of the regions.

For the determined regions, the contents of the pointer sections 323, 333, . . . , 393 in the region blocks 320, 330, . . . , 390 are further referenced. It should be noted that the pointer sections 323, 333, . . . , 393 point one of the INST blocks associated with the timbre set ST_SET7 and the timbre set ST_SET3.

For example, according to the pointer section 323 in the region block 320, the INST block 110 shown in FIG. 3 is pointed. Next, the pointer section in the pointed INST block is referenced to sequentially read the contents of the region sections in the region blocks pointed by these pointers. In the above-mentioned example, the pointer section 113 is referenced to sequentially determine whether the note number NN and the velocity VEL supplied before belong to each of the regions associated with the region sections 121, 131, . . . , 191.

Then, the above-mentioned processing is executed on all the region blocks 320, 330, . . . , 390 pointed by the pointer section 313 to search all the region blocks of the timbre sets to be combined through the pointer sections 323, 333, . . . , 393 and the INST blocks 110, 410, 510, . . . 610. This establishes the number of end region blocks (the region blocks of the timbre sets ST_SET3 and ST_SET7 to be combined) corresponding to the note number NN and the velocity VEL. The established number is equal to the number of branches.

The above-mentioned processing for identifying the branches and establishing the number of branches depends on the types of timbre set files. Generally, if the combined timbre set file is used, plural branches are allocated. On the other hand, if other timbre set file than the combined timbre set file is used, a single branch may be allocated. This is because the main purpose of the combined timbre set file is to play in concert by use of two or more existing timbre set files.

However, any number of branches corresponding to a certain note number NN and a certain velocity VEL may be set according to the contents of the region section, so that, if the combined timbre set file is used, only one branch may be allocated. On the other hand, even if other timbre set file is used, two or more branches may be allocated.

3.3 Sounding Process

In step SP3 shown in FIG. 10, the same number of channels as the number of branches allocated before is allocated to the part designated by PT. In step SP4, the waveform data to be used for sounding each branch are identified. Namely, the waveform data pointed by the pointer section in the end region block of each branch are the waveform data to be used.

In step SP5, a parameter to be used for sounding each branch are determined. First, in a timbre set file other than the combined timbre set file, the parameter section in the end region block is read to be stored temporarily. Next, the contents of the parameter section in the upper INST block are read. If a value different from the temporarily stored parameter is read, the newly read contents are preferred to update the stored contents. The last storage contents provide the final values of the parameter to be used.

In the combined timbre set file, the same processing as above is executed and then the parameter sections 322, 332, 342, . . . , 392 in the region blocks 320, 330, . . . , 390 in the upper portion of the INST block of the timbre set file to be combined are read. Then, the parameter section 312 in the INST block 310 of the combined timbre set file itself on top is read. The contents read later are preferred to update the stored contents. In this case also, the last storage contents provide the final values of the parameter to be used.

In step SP6, a music tone signal, which is PCM data, is generated on the basis of the note number NN, the velocity VEL, the identified waveform data, and the parameters. The generated tone signal is expanded into the RAM 11. The expanded waveform data are transferred to the waveform interface 5 through the driver of the waveform interface 5 and converted into an analog signal to be sounded by a sound system, not shown.

Namely, the inventive method of operating a tone generator is provided for generating a music tone in response to performance information by a desired timbre with using a mapping file defining a set of timbres and mapping a plurality of waveforms to the set of timbres. The mapping file is normally composed of a set of information blocks corresponding to the set of the timbres. The information block contains specification information for specifying waveforms associated to the corresponding timbre, and selection information for selecting one or more of the specified waveforms according to the performance information to map the selected waveform to the timbre. The inventive method is carried out by the steps of sequentially feeding the performance information to the tone generator, loading a first mapping file and a second mapping file to the tone generator, the first mapping file defining a first set of timbres and containing a plurality of waveforms originally mapped to the first set of timbres, the second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file, reading an information block of the second mapping file corresponding to the desired timbre and containing specification information for specifying waveforms contained in the first mapping file, selecting one or more of the specified waveforms according to the performance information to thereby map the selected waveform to the desired timbre, and processing the mapped waveform to generate a music tone having the desired timbre.

4. Variations

The present invention is not limited to the abovementioned embodiments. For example, the following variations are involved in the scope of the invention.

(1) In the above-mentioned embodiments, if the same parameter is specified when following an upper INST block or a region block from an end region block, the parameter of the upper block is preferred. It will be apparent that a difference from the parameter of an end block may be stored in an upper block. The sum of the parameter value in the end block and the difference in the upper block may be used as a final parameter value. Alternatively, the parameter value of an end block and a parameter value in an upper block may be added with each other in a weighted manner, a resultant added value providing a final parameter value. Alternatively still, both parameter values may be inputted in a predetermined function for synthesis, a resultant functional value providing a final parameter value.

(2) In the above-mentioned embodiments, each region section is selected on the basis of both note number NN and velocity VEL. It will be apparent that the region section may be selected on the basis of either note number NN or velocity VEL. For the selection of region sections, other various performance information may be used.

(3) In the above-mentioned embodiments, the timbre data of the additional timbre set file 200 are related to the timbre data of the normal timbre set file 100 so that there is no overlap between these timbre data. It will be apparent that the timbre data may overlap. Where an overlap is found in program change and bank select values, the timbre data of the additional timbre set file 200 may be preferred. In other words, the timbre data of the normal timbre set file 100 are partially overwritten (replaced) by the timbre data of the additional timbre set file 200.

(4) The machine readable medium 12 may be used in the music apparatus of FIG. 1 having the CPU 9 for generating a music tone in response to performance information by a desired timbre with using a mapping file defining a set of timbres and mapping a plurality of waveforms to the set of timbres. For example, the medium 12 contains program instructions executable by the CPU 9 for causing the music apparatus to perform a method comprising the steps of sequentially providing the performance information, loading a first mapping file, a second mapping file and a third mapping file, the first mapping file defining a first set of timbres, the second mapping file defining a second set of timbres, the third mapping file defining a third set of timbres and containing attribute information for linking the third mapping file to both of the first mapping file and the second mapping file, thereby combining the first set of timbres and the second set of timbres to synthesize the third set of timbres, such that the third mapping file involves an information block containing specification information for specifying information blocks contained in the first and second mapping files to indirectly specify waveforms, reading an information block of the third mapping file corresponding to the desired timbre and containing specification information for specifying information blocks contained in the first and second mapping files to indirectly specify waveforms, selecting one or more of the specified waveforms according to the provided performance information to thereby map the selected waveform to the desired timbre, and processing the mapped waveform to generate a music tone having the desired timbre.

As described and according to the invention, a certain timbre set file can utilize the waveform data of another timbre set file to generate a tone signal. Alternatively, waveform data of two or more timbre set files may be combined to generate a tone signal. This novel setup permits the generation of a variety of timbres.

While the preferred embodiments of the present invention have been described using specific terms, such description is for illustrative purposes only, and it is to be understood that changes and variations may be made without departing from the spirit or scope of the appended claims.

What is claimed is:

1. A storage medium for storing a mapping file defining a set of timbres and mapping a plurality of waveforms to the set of timbres according to performance information, the mapping file comprising a set of information blocks corresponding to the set of the timbres, the information block containing specification information for specifying waveforms associated to the corresponding timbre, and selection information for selecting one or more of the specified waveforms according to the performance information to thereby map the selected waveform to the timbre, wherein the storage medium stores a first mapping file defining a first set of timbres and containing a plurality of waveforms originally mapped to the first set of timbres, and a second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file.

2. The storage medium according to claim 1, wherein the second mapping file contains the attribute information indicating that the second set of the timbres is added as a supplement to the first set of the timbres.

3. The storage medium according to claim 1, wherein the information block contains the selection information for selecting different waveforms according to either of a key code and a key velocity contained in the performance information such that the different waveforms are dynamically mapped to the same timbre in response to a change of the key code or the key velocity.

4. The storage medium according to claim 1, wherein the information block contains individual parameter information for individually characterizing each of the specified waveforms when mapping each of the specified waveforms to the timbre, and common parameter information for commonly characterizing all of the specified waveforms.

5. The storage medium according to claim 4, wherein the common parameter information precedes to the individual parameter information when a conflict occurs therebetween.

6. A storage medium for storing a mapping file defining a set of timbres and mapping a plurality of waveforms to the set of timbres according to performance information, the mapping file comprising a set of information blocks corresponding to the set of the timbres, the information block containing specification information for specifying waveforms associated to the corresponding timbre, and selection information for selecting one or more of the specified waveforms according to the performance information to thereby map the selected waveform to the timbre, wherein the storage medium stores a first mapping file defining a first set of timbres, a second mapping file defining a second set of timbres, and a third mapping file defining a third set of timbres and containing attribute information for linking the third mapping file to both of the first mapping file and the second mapping file, thereby combining the first set of timbres and the second set of timbres to synthesize the third set of timbres, such that the third mapping file involves an information block containing specification information for specifying information blocks contained in the first and second mapping files to indirectly specify waveforms.

7. The storage medium according to claim 6, wherein the third mapping file contains the attribute information indicating that the third set of the timbres is synthesized from the first set of the timbres and the second set of the timbres.

8. The storage medium according to claim 6, wherein the information block contains the selection information for selecting different waveforms according to either of a key code and a key velocity contained in the performance information such that the different waveforms are dynamically mapped to the same timbre in response to a change of the key code or the key velocity.

9. The storage medium according to claim 6, wherein the information block contains individual parameter information for individually characterizing each of the specified waveforms when mapping each of the specified waveforms to the timbre, and common parameter information for commonly characterizing all of the specified waveforms.

10. The storage medium according to claim 9, wherein the common parameter information precedes to the individual parameter information when a conflict occurs therebetween.

11. A method of operating a tone generator for generating a music tone in response to performance information by a desired timbre with using a mapping file defining a set of timbres and mapping a plurality of waveforms to the set of timbres, the mapping file being composed of a set of information blocks corresponding to the set of the timbres, the information block containing specification information for specifying waveforms associated to the corresponding timbre, and selection information for selecting one or more of the specified waveforms according to the performance information to map the selected waveform to the timbre, the method comprising the steps of:

sequentially feeding the performance information to the tone generator;

loading a first mapping file and a second mapping file to the tone generator, the first mapping file defining a first set of timbres and containing a plurality of waveforms originally mapped to the first set of timbres, the second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file;

reading an information block of the second mapping file corresponding to the desired timbre and containing specification information for specifying waveforms contained in the first mapping file;

selecting one or more of the specified waveforms according to the performance information to thereby map the selected waveform to the desired timbre; and processing the mapped waveform to generate a music tone having the desired timbre.

12. A method of operating a tone generator for generating a music tone in response to performance information by a desired timbre with using a mapping file defining a set of timbres and mapping a plurality of waveforms to the set of timbres, the mapping file being composed of a set of information blocks corresponding to the set of the timbres, the information block containing specification information for specifying waveforms associated to the corresponding timbre, and selection information for selecting one or more of the specified waveforms according to the performance information to map the selected waveform to the timbre, the method comprising the steps of:

sequentially feeding the performance information to the tone generator;

loading a first mapping file, a second mapping file and a third mapping file to the tone generator, the first mapping file defining a first set of timbres, the second mapping file defining a second set of timbres, the third mapping file defining a third set of timbres and containing attribute information for linking the third mapping file to both of the first mapping file and the second mapping file, thereby combining the first set of timbres and the second set of timbres to synthesize the third set of timbres, such that the third mapping file involves an information block containing specification information for specifying information blocks contained in the first and second mapping files to indirectly specify waveforms;

reading an information block of the third mapping file corresponding to the desired timbre and containing specification information for specifying information blocks contained in the first and second mapping files to indirectly specify waveforms;

selecting one or more of the specified waveforms according to the performance information to thereby map the selected waveform to the desired timbre; and processing the mapped waveform to generate a music tone having the desired timbre.

13. A machine readable medium for use in a music apparatus having a CPU for generating a music tone in response to performance information by a desired timbre with using a mapping file defining a set of timbres and mapping a plurality of waveforms to the set of timbres, the mapping file being composed of a set of information blocks corresponding to the set of the timbres, the information block containing specification information for specifying waveforms associated to the corresponding timbre, and selection information for selecting one or more of the specified waveforms according to the performance information to map the selected waveform to the timbre, the medium containing program instructions executable by the CPU for causing the music apparatus to perform a method comprising the steps of:

sequentially providing the performance information;

loading a first mapping file and a second mapping file, the first mapping file defining a first set of timbres and containing a plurality of waveforms originally mapped to the first set of timbres, the second mapping file defining a second set of timbres and containing attribute information for linking the second mapping file to the first mapping file to enable mapping of the waveforms contained in the first mapping file to the second set of the timbres, such that the second mapping file may involve an information block containing specification information for specifying waveforms contained in the first mapping file;

reading an information block of the second mapping file corresponding to the desired timbre and containing specification information for specifying waveforms contained in the first mapping file;

selecting one or more of the specified waveforms according to the provided performance information to thereby map the selected waveform to the desired timbre; and processing the mapped waveform to generate a music tone having the desired timbre.

14. A machine readable medium for use in a music apparatus having a CPU for generating a music tone in response to performance information by a desired timbre with using a mapping file defining a set of timbres and mapping a plurality of waveforms to the set of timbres, the mapping file being composed of a set of information blocks corresponding to the set of the timbres, the information block containing specification information for specifying waveforms associated to the corresponding timbre, and selection information for selecting one or more of the specified waveforms according to the performance information to map the selected waveform to the timbre, the medium containing program instructions executable by the CPU for causing the music apparatus to perform a method comprising the steps of:

sequentially providing the performance information;

loading a first mapping file, a second mapping file and a third mapping file, the first mapping file defining a first set of timbres, the second mapping file defining a second set of timbres, the third mapping file defining a third set of timbres and containing attribute information for linking the third mapping file to both of the first mapping file and the second mapping file, thereby combining the first set of timbres and the second set of timbres to synthesize the third set of timbres, such that the third mapping file involves an information block containing specification information for specifying information blocks contained in the first and second mapping files to indirectly specify waveforms;

reading an information block of the third mapping file corresponding to the desired timbre and containing specification information for specifying information blocks contained in the first and second mapping files to indirectly specify waveforms;

selecting one or more of the specified waveforms according to the provided performance information to thereby map the selected waveform to the desired timbre; and processing the mapped waveform to generate a music tone having the desired timbre.

* * * * *